United States Patent [19]

Dyer

[11] Patent Number: 4,993,669

[45] Date of Patent: Feb. 19, 1991

[54] BUNDLE TIE

[75] Inventor: Edward Dyer, Germantown, Wis.

[73] Assignee: Tyton Corporation, Milwaukee, Wis.

[21] Appl. No.: 461,026

[22] Filed: Jan. 4, 1990

[51] Int. Cl.[5] ..... B65D 63/00; B21F 9/02

[52] U.S. Cl. ..... 248/61; 248/74.3; 24/16 PB; 24/30.5 P

[58] Field of Search ..... 248/61, 74.3, 68.1; 24/168, 194, 16 PB, 16 R, 30.5 P

[56] References Cited

U.S. PATENT DOCUMENTS

| | | | |
|---|---|---|---|
| 3,556,575 | 1/1971 | Farkas | 24/16 PB |
| 3,562,870 | 2/1971 | Sund | 24/16 PB |
| 3,875,618 | 4/1975 | Schuplin | 24/16 PB |
| 4,008,512 | 2/1977 | Prodel | 24/16 PB |
| 4,397,435 | 8/1983 | Fisher | 248/61 |
| 4,445,877 | 5/1984 | Love | 24/16 PB |
| 4,498,507 | 2/1985 | Thompson | 140/93.2 |
| 4,653,155 | 3/1987 | Hara | 248/74.3 |
| 4,730,615 | 3/1988 | Sutherland | 24/30.5 P |
| 4,817,901 | 4/1989 | Kuo | 24/16 PB |
| 4,862,560 | 9/1989 | Lichtenberg | 24/30.5 P |

OTHER PUBLICATIONS

"Deltec Cable Support System", Promotional Materials, Thomas Betts, Corporation, Construction and Industrial Division, 1987.

*Primary Examiner*—Reinaldo P. Machado

*Attorney, Agent, or Firm*—Lockwood, Alex, FitzGibbon & Cummings

[57] ABSTRACT

An improved cable or bundle tie arrangement includes a plastic tie strap and a tie head. The tie head includes a housing having a pair of spaced apart slots extending therein forming a pair of strap-receiving passageways. Each passageway has an entrance opening and at least one of the passageways has an exit opening. A pawl-receiving channel extends through the housing intermediate the passageways having at least one channel opening disposed substantially normal to the entrance openings. An intermediate portion of the channel intersects each of the passageways. A pawl member is mounted in the channel through the channel opening. The pawl includes a base portion and a pair of arms extending from opposed sides of the base. Each pawl arm has a free end with a blade section. The free ends of the pawl arms extend from the channel into the adjacent strap passageways for making biting and wedging engagement with an inserted tie strap to lockingly maintain the strap under tension around the article or bundle being tied.

21 Claims, 6 Drawing Sheets

Fig.3
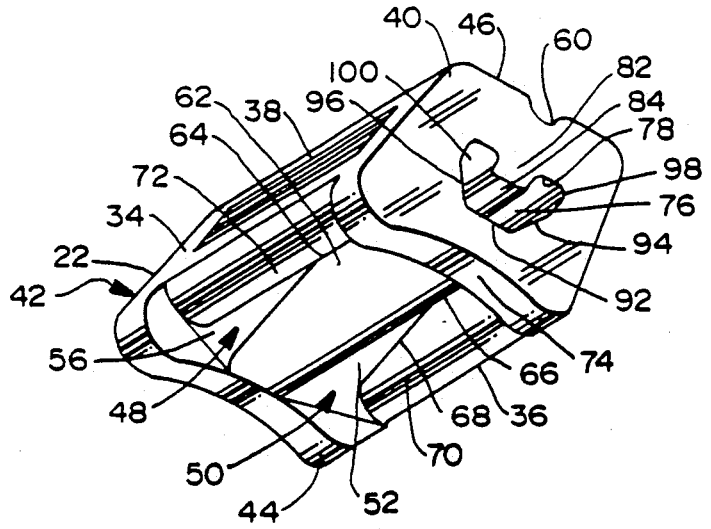
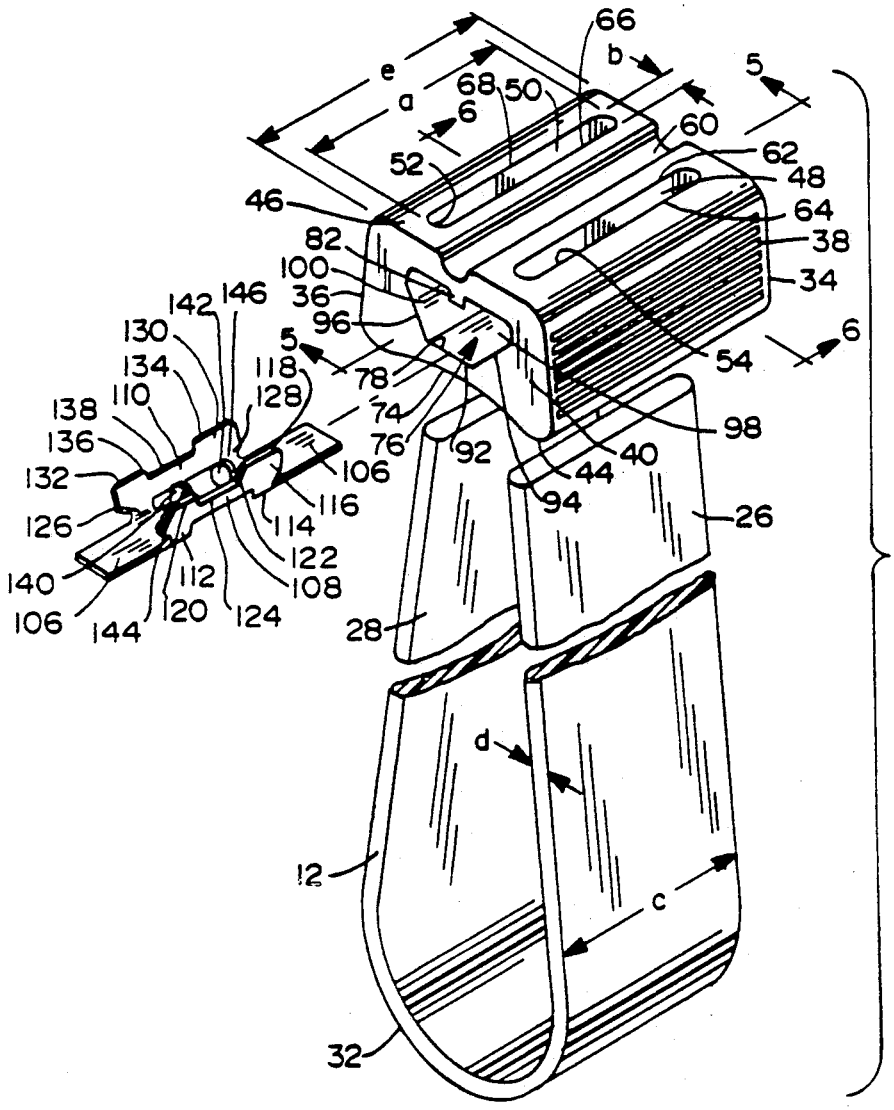
Fig.4

BUNDLE TIE

BACKGROUND OF THE INVENTION

The present invention relates to bundle ties of the type including a tie strap and a tie head wherein the strap may be wrapped around an object or bundle and cinched or tensioned through the tie head to securely, lockingly engage the object. More particularly, it relates to a new and improved bundle tie head and tie system especially suited for use in outdoor environments which is characterized by low insertion forces and high withdrawal forces, as well as, high loop tensile strength.

Bundle ties are in widespread use for bundling together electrical wires or cables to form harnesses in telecommunications equipment, aircraft, motor vehicles and the like. In U.S. Pat. No. 4,498,507, a bundle or cable tie is described which includes a plastic tie strap and a tie head having a pair of strap passages and a metal locking pawl. The housing is of a generally rectangular configuration including a solid block portion having a four-sided shroud projecting from one end defining an open recess. The strap passages are parallel to each other and extend along opposed sides of the tie head from the opposite entry end of the block portion into the shroud recess. The metal pawl is a stamped plate which is inserted through the recess into an intermediate parallel slot defined in the block portion. A deflectable locking tang on the pawl engages a shoulder in the slot to retain the pawl in the housing. Two slits are provided in the opposed free end of the plate to define a central tooth and a pair of spaced outer teeth which are oppositely bent away from each other so that the teeth are directed toward the opposed sides of the shroud adjacent a strap exit from the block portion.

In accordance with the design described in U.S. Pat. No. 4,498,507, the pawl is cantilever-mounted so that it is deflectable. Insertion of the strap end through one strap passage deflects the pawl toward the other strap passage. The strap is passed around the bundle to be tied and the second strap end is inserted into the second strap passage. During insertion of the second strap end, the strap must deflect the pawl out of its path, causing the opposed pawl teeth to engage the strap in the opposite passage. Continued insertion requires a deflection of the teeth against a compressive load which must be overcome. As a result, the overall design provides an undesirably high insertion force. Moreover, the points along the strap engaged by the pawl teeth form key stress regions where failure is expected to occur first, compared to other regions along the strap. In this patented design, these key stress regions are located in the open shroud area and are therefore undesirably exposed to adverse environmental conditions.

Another commercially available bundle tie arrangement of the environmental type includes a one piece cable tie head including a central partition wall and a pair of spaced-apart tie strap receiving passageways disposed adjacent opposed sides of the partition wall. A pair of independent pawl members are angled into each strap passage from an outer position in the housing. The pawls are inserted into an open top of the housing. The pawls have a pair of feet projections extending from opposed sides of the lower region thereon which must be stitched into small holes provided in a lower base wall provided in the housing. Thereafter, these feet are staked over to retain the pawl in the housing in a deflectable manner.

An advantage of this design over that described in U.S. Pat. No. 4,498,507 is that the insertion force associated with the insertion of each side of the strap is determined by the independent action of the pawl on that side of the tie housing, so that insertion of the first strap end does not disadvantageously increase the insertion force needed to insert the second end of the strap. As with the earlier design, this second design has an open strap-engaging contact area so that key stress regions are exposed to the elements under environmental conditions.

A further drawback common to each of the above designs is that they are relatively difficult to manufacture. Each of these pawl members include mounting features extending therefrom which must be properly aligned and positioned in a receiving structure in the housing. Moreover, insertion of the pawl in the housing is dedicated for one-way insertion, i.e., through the open side only, so that mounting of the pawls in the housings is a polarized function. This leads to a number of manufacturing disadvantages because equipment which ensures the proper orientation of the parts being fed into the pawl insertion equipment is required. This additional equipment increases the cost of producing the cable tie parts, which is reflected in product pricing.

In order to overcome the shortcomings of the prior art cable ties, it is an object of the present invention to provide a new and improved bundle or cable tie for use with a plastic tie strap exhibiting low insertion forces and high withdrawal forces for each side of the strap.

It is another object of the present invention to provide a new and improved bundle tie which is easy to assemble and inexpensive to manufacture which is capable of automated assembly.

It is a further object of the present invention to provide a new and improved bundle tie for use in outdoor environments wherein the key stress contact areas made between the tie head and the tie strap are protected from exposure to the elements.

SUMMARY OF THE INVENTION

In accordance with these and other objects, the present invention provides a new and improved tie head for use with an elongate plastic tie strap for forming an improved bundle tie arrangement. The tie head comprises a housing including a pair of spaced apart slots extending therein forming a pair of strap-receiving passageways. Each passageway has an entrance opening and at least one of the passageways has an exit opening. The passageways are adapted to closely, slidably receive and guide the ends of the strap therein. Each passageway includes a surface extending adjacent to a sidewall of the housing.

The housing further includes a pawl-receiving channel extending through the housing intermediate the passageways and generally parallel to the surfaces of the passageway. A pair of opposed openings to the pawl-receiving channel are disposed substantially normal to the entrance and exit openings of the strap passageways. An intermediate portion of the channel intersects each of the strap receiving passageways.

The improved cable or bundle tie arrangement of the present invention also includes a pawl member mounted in the channel. The pawl has an elongate base portion and a pair of arms extending outwardly from opposed sides of the base. Each arm has a free end with a blade section. The free ends of the arms of the pawls each extend from the channel into the adjacent passageway so that the blade sections are positioned for making contact with an inserted end of the strap. The new and improved tie head of this invention also includes mounting means for retaining the pawl in position in the channel.

In accordance with the arrangement, each of the ends of a cable tie strap may be inserted through the entrance openings into each passageway. The blade sections of each pawl located in each passageway are easily deflected upon insertion of the strap. Once inserted, the strap is prevented from being withdrawn by a biting and wedging engagement of the strap between the pawl blade sections and the surfaces of the passageways.

In use, one end of the strap is generally inserted into a first strap passageway and the remaining end of the strap is passed around a single object or a bundle of articles. Introduction of the opposed end of the strap into the second strap passageway independently and easily deflects the pawl out of the path of insertion. Tightening of the strap places the strap under tension as well as the articles contained within its grasp. The cinched bundle tie is capable of withstanding heavy loads under tension for an extended period of time.

An advantageous feature of the design is that the tie arrangement may be reuseable. More particularly, the strap may be cut adjacent one of the entrance openings to release the strap. The remaining portions of the strap may be pulled completely through the exit of the other passage to disengage the strap from the tie head. The slightly shorter strap may then be re-inserted into the tie head entrances to form a new tie. In this manner, the tie head and the same length of strap are re-useable. This is an advantage in the field because line technicians are not required to carry a supply of tie heads and straps with them. Furthermore, straps can be conserved thereby eliminating waste and expense.

In a preferred embodiment, an improved cable tie arrangement adapted for outdoor use, for example, in telecommunications applications having a loop tensile strength in excess of 250 pounds and prolonged environmental use life is provided. In these outdoor applications, the tie arrangement includes a tie head housing formed of a high strength, weather resistant thermoplastic polyacetal material Preferably, the strap is also formed from the same weather resistant material. Moreover, the pawl member is preferably made from a high performance $\frac{1}{4}$ temper grade stainless steel stock referred to as SS301. This grade possesses satisfactory mechanical strength and corrosion resistance to withstand long exposure to outdoor environments.

In accordance with other preferred features of the invention, both the housing and the pawl are advantageously designed to be symmetrical. The pawl has no polarizing features on it and the head is provided with channel openings on both sides of the housing. These features adapt the part for automated assembly by removing the need to specially orient the housing and channel opening with respect to the pawls, making automated assembly simpler and less expensive. Moreover, in accordance with a preferred embodiment, the pawl is designed for self-centering insertion and press fit engagement within the channel of the housing member. In accordance with this aspect, a pair of spaced apart outwardly directed rounded retention barbs may be provided on the pawl member adapted to be engaged in a corresponding groove provided on a retention rib within the channel of the housing. All entries to the channel are provided with gradual lead-ins to facilitate automated pawl insertion. In the inserted condition, the pawl is restrained from any movement relative to the housing.

In accordance with still another aspect of this design arrangement, the locking action of the pawl blades against the strap ends is directed against portions of the housing where the risk of deflection under stress is at a minimum to thereby reduce the possibility of tie loosening or failure.

Other objects and advantages of the present invention will become apparent from the following detailed description taken in conjunction with the drawings and which:

BRIEF DESCRIPTION OF THE DRAWINGS

FIG. 3 an enlarged perspective view of the new and cable tie head of the invention showing the strap entry si of the tie head housing;

FIG. 4 is an exploded perspective view of the new and improved bundle tie arrangement of the invention viewed from the strap exit side showing side insertion of the metallic pawl in the housing and the looped tie strap for insertion into the passageways;

DETAILED DESCRIPTION OF THE PREFERRED EMBODIMENTS

Figure 1:
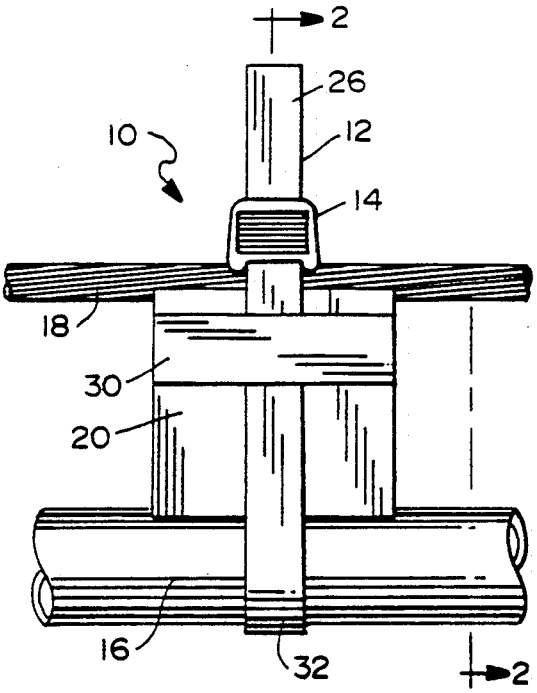
FIG. 1 is a side elevation view of a new and improved environmental bundle tie arrangement in accordance with the present invention illustrating a same-side, parallel entry type of tie, shown in use securing a large telecommunications cable and a spacer, to a stranded metal support cable.
Figure 2:
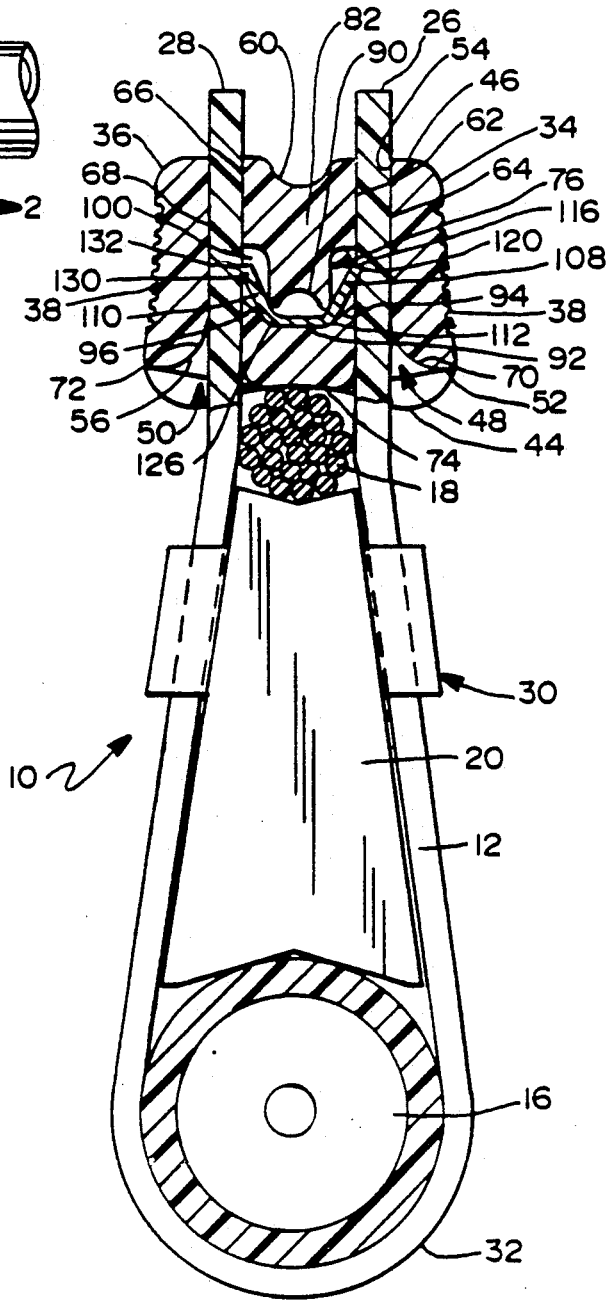
FIG. 2 is an enlarged end elevation view, partly in section, of the new and improved cable tie arrangement, take along view lines 2—2 in FIG. 1.

Referring now to FIGS. 1-2, the new and improved bundle tie assembly or arrangement, generally referred to by reference numeral 10, is shown. Cable or bundle tie assembly 10 includes an elongate plastic tie strap 12 and a tie head 14. FIGS. 1-2 illustrate a common outdoor application for the arrangement, wherein cable tie assembly 10 is shown in use securing an insulated telecommunications or power cable 16 onto a smaller diameter stranded steel support cable 18. A spacer member 20 is interposed between telecommunications cable 16 and support cable 18 to maintain the cables in spaced relation to each other.

As shown in FIG. 2, tie head 14 includes a tie head housing 22 and an internal pawl member 24. Tie head 14 lockingly engages spaced apart locations of tie strap 12 within housing 22 to cinch or bundle articles placed within its loop or grasp under tension.

For the application illustrated in FIGS. 1-2, a first end 26 of tie strap 12 is inserted into one side of tie head 14 to secure it with one side of pawl member 24. The opposing free end 28 of strap 12 may be threaded through slot 30 provided a side of spacer member 20, around cable 16 and back up through slot 30 on the other side of spacer members 20 to form a strap loop section 32. Tie head 14 is positioned over support cable 18 and the free end 28 is inserted into the other side of the tie head 14. Tie strap 12 is cinched or tensioned by pulling, either by hand or with a hand tool, one or both of the strap ends up through the tie head 14 until the loop 32 is shortened sufficiently to tighten all of the parts of assembly 10 together. Alternatively, strap ends 26 and 28 may be pre-assembled around the cables and spacer member 20 and introduced into tie head 14 at about the same time.

Cable tie arrangement 10 as shown in FIGS. 1-2 is of a same-side, parallel-entry type, which means that the strap ends 26 and 28 are inserted from the same side of the tie head 14 and extend through tie head housing 22 parallel to each other. In accordance with this preferred embodiment, cable tie arrangement 10 is intended for outdoor use and accordingly, tie strap 12 and tie head housing 22 are preferably made from a high strength environmentally-resistant thermoplastic material capable of retraining its physical properties during prolonged exposure to humidity, heat and sunlight or ultraviolet radiation.

More particularly and referring now to FIGS. 3-6, the structural details of the preferred tie head 14 are shown. As depicted therein, tie head housing 22 is of a generally rectangular configuration. Housing 22 includes a pair of opposed sidewalls 34 and 36, each provided with an anti-slip ribbed surface region 38. Sidewalls 34 and 36 are interconnected by a pair of spaced and opposed end walls 40 and 42, as well as, by bottom wall 44 and opposed top wall 46. A pair of generally parallel spaced apart slots extend through housing 22 to define a pair of strap-receiving passageways 48 and 50. Passageway 48 includes an entrance opening 52 in bottom wall 44 and an exit opening 54 in top wall 46. Passageway 50 similarly includes an entrance opening 56 in bottom wall 44 and an exit opening 58 in top wall 46. Top wall 46 also includes a central convex groove 60 intermediate exit openings 54 and 58. Groove 60 is provided to reduce the cross-sectional thickness of the part in this region to prevent formation of voids or air bubbles during injection molding of the housing 22.

As is best shown in FIG. 4, passageway 48 defines an inner housing surface 62 and an outer or exterior surface 64. Passageway 50 also defines an inner or interior surface 66 and an outer or exterior surface 68. Passageways 48 and 50 are each provided with a length dimension, a, and a width dimension, b, to closely slidably receive and guide tie strap 12, shown in FIG. 11 to have a corresponding width dimension, c, and thickness dimension, d. Length dimension, a, of passageways 48 and 50 is less than the length, e, of tie head housing 22 as shown in FIG. 4.

The lower portions of passageways 48 and 50 each include a gradually outwardly flaring curved surface segment 70 and 72 extending between outer surfaces 64 and 68 and sidewalls 34 and 36, respectively. As a result, the entrance openings 52 and 56 are enlarged extending part way up sidewalls 34 and 36.

Figure 11:
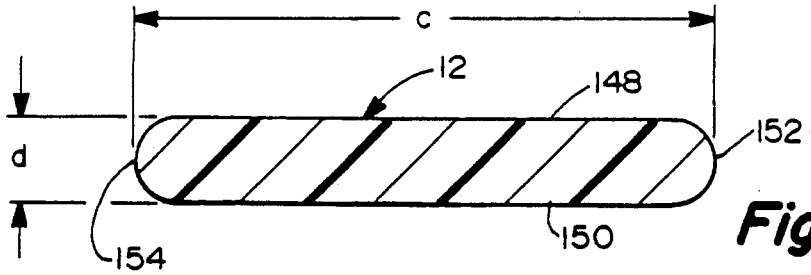
FIG. 11 is an elevated cross-sectional view of the cable tie strap for use in the new and improved cable tie arrangement of the present invention.

The bottom wall 44 of housing 22 is preferably curved in a convex manner to impart a cable or bundle-engaging saddle formation. More particularly, the overall height of housing 22 adjacent the intersections of sidewalls 34 and 36 and endwalls 40 and 42 is a first dimension, f. The central portion of the housing is provided with a smaller height dimension, g, to define a gently recessed cable engaging surface 74 disposed in a central location of bottom wall 44 between inner passageway surfaces 62 and 66. Cable engaging surface 74 is intended to abuttingly engage a surface of the object or bundle being tied, such as support cable 14 in arrangement 10 (FIGS. 1-2). The height dimension, h, of the intermediate cut away portions of sidewalls 34 and 36, defined between the top wall 46 and curved surface segments 70 and 72, is chosen to be smaller than height dimension g and height dimension f. The difference between g and h is selected to be greater than or equal to the strap thickness, dimension d (FIG. 11).

The curved cable engaging bottom surface 74 of bottom wall 44 cooperates with the enlarged entrance openings 52 and 56 to facilitate strap insertion and to enable tie head 14 to be employed with a wide range of cable or bundle diameters. More particularly and referring again to FIG. 2, the stranded steel support cable 18 is shown engaging curved bottom surface 74. The diameter of support cable 14 is narrow relative to the centerline separation, i, of passageways 48 and 50. As a result, the ends 26 and 28 of tie strap 12 are not angled sharply into passageways 48 and 50. However, if the support cable 18 and spacers 20 are removed from the arrangement 10, curved bottom surface 74 would engage the larger diameter telecommunications or power cable 12. The diameter of cable 12 is greater than the centerline spacing, i, of passageways 48 and 50. As a result strap ends 26 and 28 must be re-directed through a 90° angle to pass up through passageways 48 and 50. Curved surface segments 70 and 72 ensure that the change in direction is gradual. Accordingly any stresses developed in the strap 12 are distributed along the curved surface segments 70 and 72.

Curved segments 70 and 72 are also upwardly displaced from curved bottom surface 74 by a distance g-h, which is equal to or greater than strap thickness, d. This upward relief ensures a smooth strap transition from the circumference of the cable 12 into tie head 14. If curved surface segments 70 and 72 were not provided and a right angle shoulder was substituted, the tie strap 12 would undergo a sharp right angle bend at the point of entry to the passageways 48 and 50. A sharp bend in the strap would cause localized stresses in the strap in use, increasing the likelihood of strap failure along those sharply bended regions. Surface segments 70 and 72 ensure that the stresses are delocalized over a gradually curved surface. Moreover, relieving the curved surface segments 70 and 72 upwardly, and away from curved bottom surface 74 permits low stress attachment to an even broader range of bundle or cable diameters.

In accordance with this invention, the new and improved tie head housing 22 additionally includes a pawl-receiving channel 76, extending intermediate passageways 48 and 50. Pawl-receiving channel 76 includes a pair of opposed channel openings 78 and 80 disposed in end walls 40 and 42, respectively. Channel openings 78 and 80 are located in housing 22 substantially normal to entrance openings 52 and 56 and normal to outer surfaces 64 and 68 of passageways 48 and 50, respectively. An intermediate portion 82 of channel 76 intersects each of passageways 48 and 50.

Figure 5:
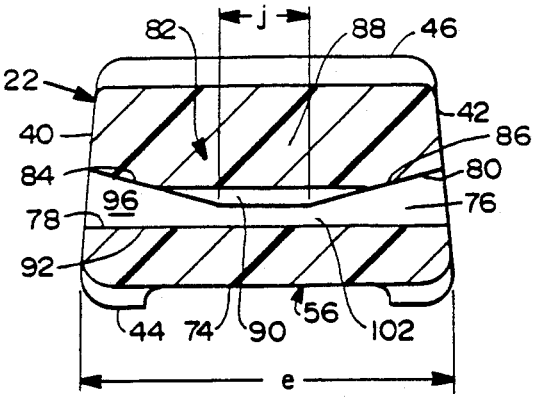
FIG. 5 is an elevated longitudinal sectional view of the new improved tie head housing taken along view lines 5—5 in FIG. 4.
Figure 6:
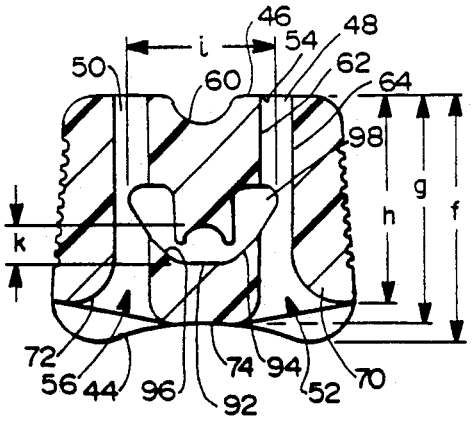
FIG. 6 is an elevated cross-sectional view of the new and improved tie head housing of the invention taken along view lines 6—6 in FIG. 4.

In accordance with the preferred embodiment as shown in FIGS. 2 and 6, pawl-receiving channel 76 has a generally w-shaped cross-sectional configuration defined in part by a bowed projecting retention rib 82 extending within channel 76. Retention rib 82, as shown in FIG. 5, is provided with tapering end portions 84 and 86 and an intermediate portion 88 which is provided with a convex pawl-engaging groove 90. Pawl-receiving channel 76 also includes a planar base or floor surface 92 opposite retention rib 82 and extending the length of channel 76. A pair of outwardly angled wall surfaces 94 and 96 extend in channel 76 from opposite side edges of floor surface 92. Channel 76 is further defined by a pair of spaced-apart, oppositely directed lobes 98 and 100 which extend between angled surfaces 94 and 96, respectively, to opposed sides of retention rib 82.

Retention rib 82 including intermediate portion 88 with its semi-circular convex groove 90 together with floor surface 92 effectively define a constricted region 102 along an intermediate portion of channel 76. Constricted region 102 has a length dimension, j, and a height dimension, k, as shown in FIGS. 5 and 6. The dimensions j and k of constricted region 102 are selected to cooperate with features provided on pawl member 24 to provide a self-centering guided and locking engagement of the pawl 24 within channel 76 in a manner to be more particularly described hereinafter.

Figure 7:
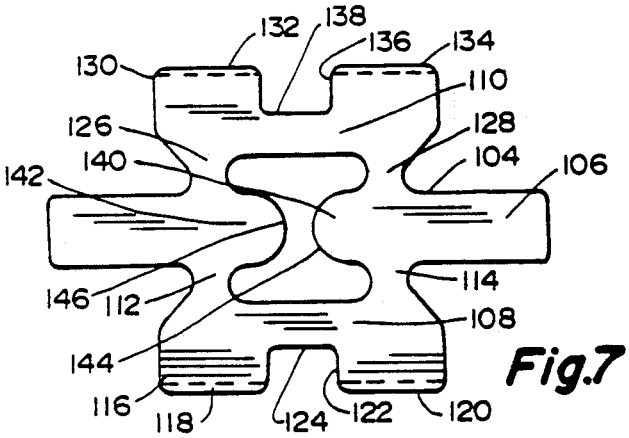
FIG. 7 is a top plan view of a stamped metallic blank for forming the pawl for use in the new and improved tie head of the invention.

Referring now to FIGS. 4 and 7–10, the new and improved pawl member 24 for use in the tie head 14 of this invention is shown. In greater detail and as shown in FIG. 7, the pawl member may advantageously be stamped and formed from a blank 104 of sheet metal stock. Blank 104 includes an elongate, generally rectangular base portion 106. A pair of opposing lateral arms 108 and 110 extend on opposed sides of base portion 106, intermediate the length, l, of base portion 106. Lateral arm 108 is interconnected or cantilevered to base portion 106 at one end by means of bight portions 112, 114. The opposing free end 116 of arm 108 is provided with spaced apart chamfered edges defining blade contact sections 118 and 120. An intermediate cut out 122 having a generally rectangular configuration is disposed in free end 116 to define strap stop surface 124 extending parallel to and inwardly spaced from blade contact sections 118 and 120.

Similarly, lateral arm 110 is interconnected or cantilevered from the opposite side of base portion 106 at one end by bight portions 126 and 128. The opposing free end 130 of arm 110 is also chamfered at spaced locations along the edge to define spaced blade contact sections 132 and 134. A cut out 136 is also provided to define a strap stop surface 138.

The central portion of blank 104 is punched to define a pair of opposing spaced-apart barb projections 140 and 142 extending from the base portion 106 to rounded semi-circular free edges 144 and 146, respectively.

Figure 10:
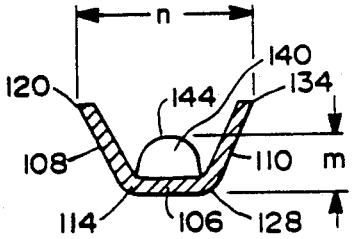
FIG. 10 is an elevated sectional view of the formed pawl taken along view lines 10—10 in FIG. 9.
Figure 8:
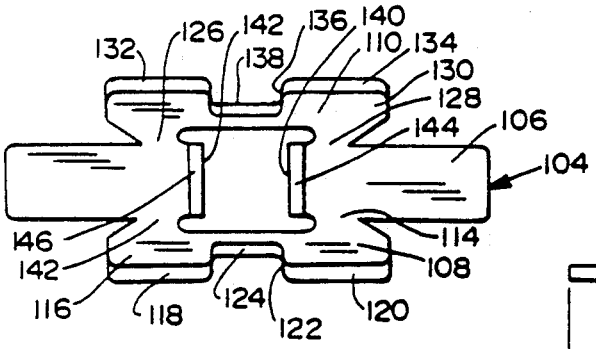
FIG. 8 is a top plan view of the fully-formed metallic pawl of the invention.
Figure 9:
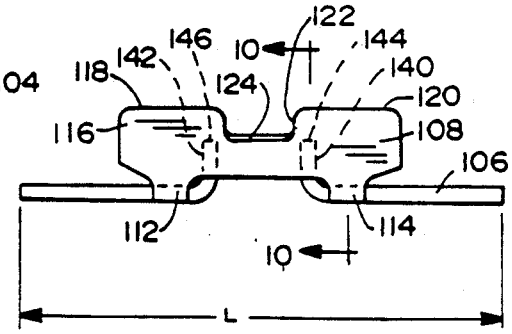
FIG. 9 is a side elevation view of the fully formed pawl.

Referring now to FIGS. 8–10, pawl member 24 may be made from blank 104 by forming the opposed arms 108 and 110 upwardly along their respective bight portions 112, 114 and 126, 128 and by forming the opposing barb projections 140 and 142 to an upstanding position. As seen in FIG. 9, barbs 140 and 142 are formed or bent upwardly until they assume a substantially perpendicular position with respect to the base portion 106 having a height dimension, m. Lateral arms 108 and 110 are bent upwardly to the angled position best seen in FIG. 10 so that the opposing blade contact sections, namely blade contact sections 118 and 132 and blade contact sections 120 and 134, are spaced apart by a dimension, n, which is slightly less than the centerline spacing, i, of strap-receiving passageways 48 and 50.

Figure 12:
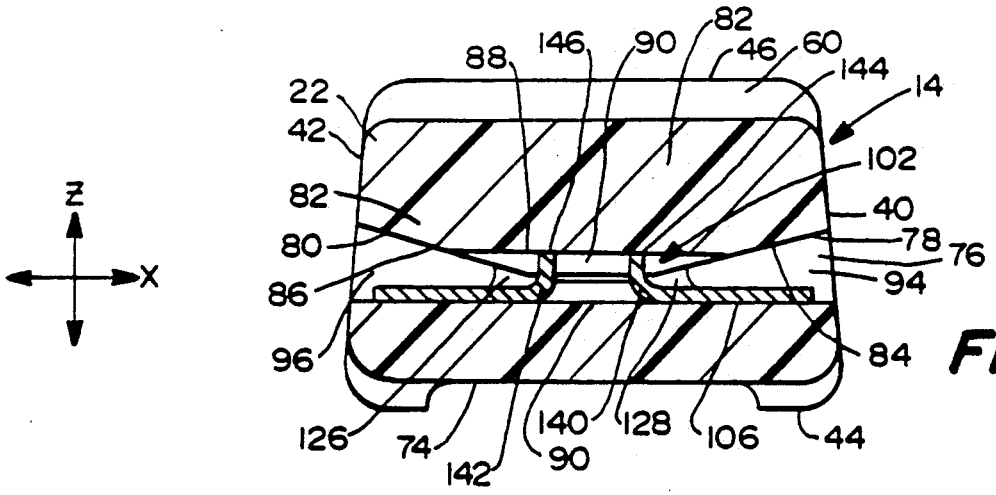
FIG. 12 is an elevated sectional view similar to FIG. 5 showing the new and improved cable tie head of the invention in an assembled condition with the pawl member mounted in the channel.
Figure 13:
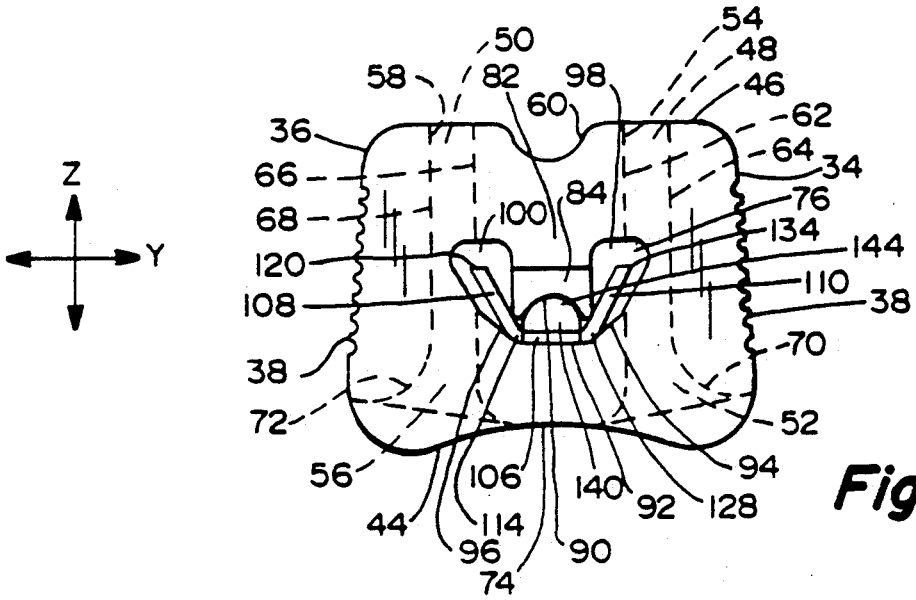
FIG. 13 is an elevated sectional view of the assembled tie head of the invention taken along view lines 13—13 in FIG. 12.

The assembly of pawl member 24 with tie head housing 22 to form the new and improved tie head 14 will be readily apparent from FIGS. 12–13. In accordance with this invention, pawl 24 is mounted within pawl receiving channel 76 by introducing either of the ends of pawl base portion 106 into either of the channel openings 78 or 80 provided in endwalls 40 and 42. Continued insertion of pawl 24 causes the rounded edge 144 or 146 on a leading barb projection 140 or 142 to engage a tapered end 84 or 86 provided on retention rib 82, which causes base portion 106 to be moved downwardly and received on floor surface 92 by the guiding influence of angled wall surfaces 94 and 96. Upon further insertion, each of the rounded edge portions 144 and 146 are received within the complimentary convex groove 90 provided in the intermediate portion 88 of retention rib 82 in a surface to surface engagement and the pawl is press-fittingly engaged in the constricted region 102, between the floor surface 92 and convex groove 90. In this inserted condition, pawl arms 108 and 110 extend within lobes 98 and 100, so that the free ends 116 and 130 extend from channel 76 into the adjacent passageways 48 and 50, respectively.

In accordance with the preferred self-centering mounting arrangement, the pawl 24 is cooperatively engaged in the channel 76 in a manner which limits substantially any lateral or rotational displacements of the pawl 24 within the channel 76 in use. More particularly, as will be apparent to those skilled in this art, lateral or rotational displacements in either the x or z directions, as shown in FIG. 12, are prevented by the wedging, press-fit engagement of the edges 144 and 146 against groove 90 and by base portion 106 against floor surface 92. This occurs because barbs 140 and 142 are each provided with a height dimension, m, which is slightly greater than the height, k, of constricted region 102. Edges 144 and 146 are also spaced apart by a distance slightly less than the length, j, of constricted region 102. A tool including a driver head and anvil may be used to press-fit the pawl 24 into channel 76 and to center or locate the base 106 of the pawl within respect to the length, e, of channel 76.

Lateral or rotational displacements with respect to the y or z axis, shown in FIG. 13, are prevented by the two spaced apart lines of curving surface to surface contact between edges 144 and 146 and groove 90 as well as by the socketing contact against the base 106 and bight portions 112, 114 and 126, 128 provided by floor surface 92 and the adjacent angled wall surfaces 94 and 96.

In the fully inserted position best shown FIGS. 2 and 13, the blade contact sections 118 and 120 of arm 108 extend into strap passageway 50. Similarly, blade contact sections 132 and 134 extend into strap passageway 48. Insertion of the ends 26 and 28 of a tie strap 12 into strap passageways 48 and 50 causes the free ends 130 and 116 of arms 110 and 108 to be resiliently deflected inwardly towards the opposing inner surfaces 62 and 66 of passageways 48 and 50, respectively. Each arm 110 and 108 may be independently deflected in a low insertion force manner. Arm deflection caused by strap insertion is in the same direction as the new permanent set introduced by upwardly angling the arms in the pawl-forming operations. As a result, strap insertion causes a bending force on the arms, which easily permits them to be deflected. The resilient elastic nature of the arms 108, 110 causes them to return to their original formed position which causes the chamfered blade contact sections 118, 120 and 132, 134 to bite into the adjacent surfaces of strap ends 26 and 28. A withdrawal force on strap ends 26 and 28 causes compressive forces to develop along arms 108 and 110 and the strap ends 26 and 28 become wedgingly retained between the blade sections and the outer surfaces 64 and 69 of passageways 48 and 50. Withdrawal forces on the strap ends 26 and 28 cause the blade contact sections 118, 120 and 132, 134 to bitingly penetrate the surfaces of the strap. Penetration of the blades into the strap surfaces is halted when the strap surfaces are engaged on the strap stop surfaces 124 and 138, located on arm free ends 116 and 130, respectively.

In accordance with the preferred embodiment shown in FIGS. 1–13, each arm 108 and 110 is provided with a pair of spaced apart blade contact sections 118, 120 and 132, 134 which cause the tie strap to be engaged against portions of outer passageway surfaces 64 and 68 which lie adjacent end walls 40 and 42, where housing deflection under load is at a minimum. This feature is important in high strength environmental cable tie applications to provide added assurance that the strap is maintained under substantially constant tension for extended periods of time. Alternatively, the free ends 116 and 130 may be provided with a continuous blade contact section which wedges an engaged strap against central portions of outer surfaces 64 and 68 and sidewalls 34 and 36. This locking arrangement may be satisfactory for most end use cable tie applications. In environmental applications, however, the tying arrangements are generally highly tensioned and the parts are subject to exposure to adverse environmental factors such as exposure to light, heat and humidity. Housing deflection is possible at the middle sections of sidewalls 34 and 36 if they are heavily loaded and subjected to these conditions for prolonged periods of time. Deflection of the housing may undesirably permit slippage between the strap and the tie head. For this reason, the environmental cable tie 14 of the preferred embodiment is designed so that the strap engaging forces are directed at the sides of the housing adjacent the ends of the passageways to substantially reduce or eliminate the possibility of housing deflection under load.

Referring again to FIG. 2, the new and improved tie head 14 of this invention is provided with a closed or solid top wall 46. The areas of engagement by the pawl 24 and housing 22 against the strap 12 are centrally located within the tie head 14. Accordingly, the key stress areas of the strap comprising the regions engaged by the pawl, where failure may be expected to occur soonest, are not exposed to adverse environmental conditions in the improved tie head of this invention.

In accordance with the invention, cable tie head 14 may be separately sold or may be sold as a kit together with a supply of a tie strap material in the form of discrete lengths or in a reel of strap. Cable tie head 14 is intended for outdoor applications and accordingly both tie head housing 22 and tie strap 12 should be molded from a weather resistant thermoplastic molding composition. A preferred material for making the housing 22 and strap 12 is a thermoplastic polyacetal molding composition sold under the tradename DELRIN TM by DuPont. The pawl member should be stamped and formed from a weather resistant grade of metallic sheet stock. A preferred material is $\frac{1}{4}$ temper SS 301 grade stainless steel stock. The new and improved tie head 14 may also be used for indoor uses in which case, any moldable thermoplastic material such as nylon, polyesters, polycarbonate or the like may be suitable. Similarly, where environmental corrosion is not a problem, the pawl member may be formed from other metal stocks such a steel, phos-bronze, beryllium copper and the like.

Referring briefly to FIG. 11, in accordance with this invention, new and improved bundle tie assemblies or arrangements 10 are provided including the tie head 14 and a tie strap 12. Preferably tie strap 12 is a precision molded strap having a constant cross section. Strap 12 should include a pair of opposed major surfaces, 148 and 150 which are substantially parallel to each other over the entire width and length of the strap. The edge portions 152 and 154 are preferably radiused. Surfaces 148 and 150 should be parallel to define a uniform cross-section to the strap so that loads are evenly distributed when the strap is placed under tension when cinched through tie head 14.

Figure 14:
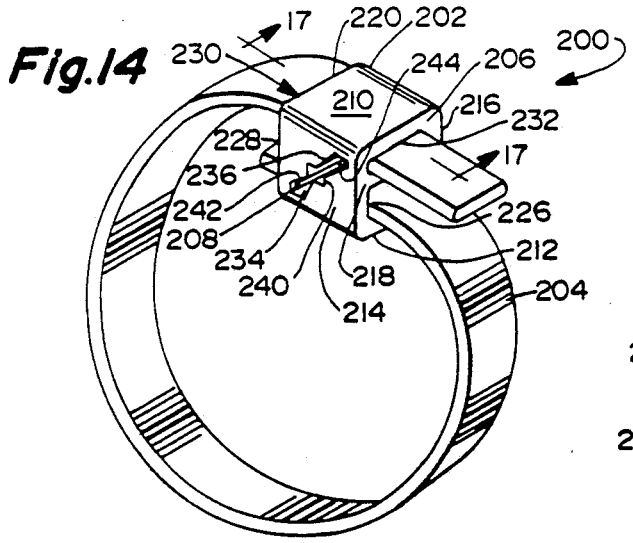
FIG. 14 is a perspective view of an alternate cable tie arrangement in accordance with present invention.

Referring now to FIG. 14, an alternate cable tie arrangement, generally referred to by reference numeral 200 is shown. Cable tie arrangement 200 also includes a tie head 202 and a tie strap 204. Tie head 202 includes a one-piece or unitary molded housing 206 and a one piece or unitary metallic pawl member 208. As shown in FIG. 14, cable tie head 202 is of an opposite-side, parallel-entry type wherein end portions of strap 204 are retained in the tie head 202 in a vertically overlapping manner.

Tie head housing 206 is of a generally rectangular or block like configuration including a top wall 210, an opposed bottom wall 212, a pair of opposed sidewalls 214 and 216 and a pair of opposed end walls 218 and 220. A pair of parallel vertically spaced apart slots extend through housing 206 to define a pair of strap-receiving passageways 222 and 224. Lower passageway 222 includes an enlarged entrance opening 226 defined in end wall 218 and has an opposing exit opening 228 defined in endwall 220. Similarly, upper passageway 224 has an enlarged entrance opening 280 defined in end wall 220 and an exit opening 232 defined in endwall 218.

In accordance with the invention housing 206 additionally includes a pawl-receiving channel 234 intermediate passageways 222 and 224 extending between a pair of opposed openings 236 and 238 defined in the opposed sidewalls 214 and 216, respectively An intermediate portion of channel 234 intersects each of strap passageways 222 and 224.

Figure 17:
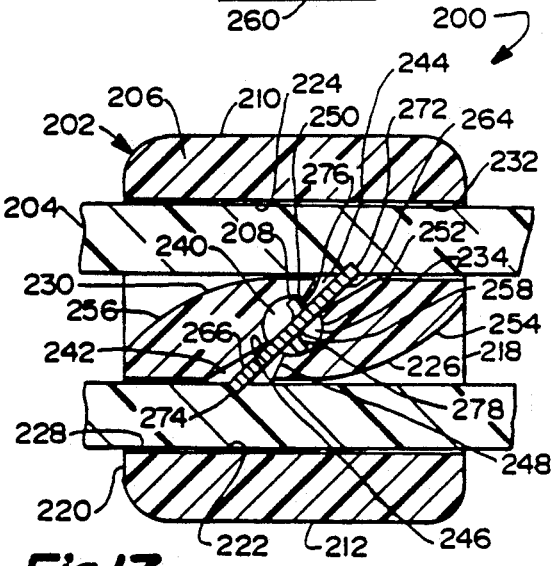
FIG. 17 is an elevated cross-sectional view of the alternate assembled tie head taken along view lines 17—17 in FIG. 14.

As is best shown in FIG. 17, pawl-receiving channel 234 includes a cross-sectional profile having a generally circular intermediate portion 240 and a pair of opposing angular lobe portions 242 and 244. Four angular shoulders 246, 248, 250 and 252 are defined at the junction between circular portion 240 and lobe portions 242 and 244. Moreover, as is best seen in FIG. 17, entrance openings 226 and 230 are provided with enlarged tapering lead-in sections 254 and 256, respectively, to facilitate strap end insertion into the tie head housing 202 and also to provide a readily visually detectable indicator of the appropriate strap insertion direction for each of passageways 222 and 224.

Figure 16:
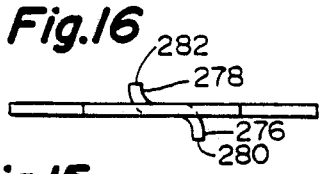
FIG. 16 is an elevated side view of the pawl member shown in FIG. 15.
Figure 15:
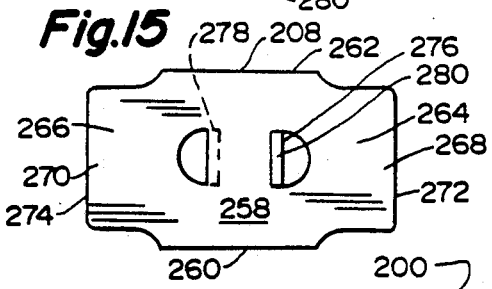
FIG. 15 is a top plan view of the pawl for use in the alternate tie head housing of FIG. 14.

Referring now to FIGS. 15–16, an alternate pawl member 208 for use with tie head housing 206 is shown. Pawl member 208 includes a generally rectangular planar base portion 258 defined between a pair of parallel side edges 260 and 262. A pair of arms 264 and 266, each extend from opposing sides of base portion 258 to a free end 268, 270 having edge portions 272 and 274 as shown. A pair of spaced apart mounting projections 276, 278 are struck out from the plane of base portion 258 and extend in opposite directions substantially perpendicularly from the base 258. Each mounting projection 276 and 278 is provided with an upstanding rounded, semi-circular edge portion 280 and 282, respectively.

Referring again to FIG. 17, the alternate tie head 200 is assembled by introducing either edge 260 or 262 of the pawl 208 into either of the channel openings 236 and 238 so that upstanding mounting projections 276 and 278 are received in the circular center portion 240 of the channel 234. In the inserted position, each of the arm portions 264 and 266 are disposed within angled lobe portions 242 and 244 and their respective free ends 264 and 266 extend at an angle into the adjacent strap-receiving passageways 222 and 224. The free edge portions 272 and 274 form blade contacts for bitingly and wedgingly engaging surface locations along the strap 204. In accordance with this embodiment, portions of housing sidewalls 214 and 216 adjacent the central circular portion 240 of channel 234 are heat-staked or otherwise deformed to retain the pawl 208 in channel 234.

In the inserted condition shown in FIG. 17, pawl 208 is pivotally, rotatably mounted within channel 234. Rounded edges 280 and 282 on mounting projections 276 and 278 are engaged within circular center portion 240 which centers the pawl 208 within housing 206 and permits pawl 208 to pivot in either a clockwise or counterclockwise direction. Accordingly, insertion of either or both of the strap end portions through entrance openings 226 and 230 causes pawl 208 to rotate in a clockwise direction, as shown in FIG. 17, until opposing planar surfaces of the base portion 258 abut shoulders 246 and 252 provided in channel 234. This prevents further clockwise rotation. The edge portions 272 and 274 on the free ends 268 and 270 of pawl arms 264 and 266 bitingly engage or dig into the adjacent surfaces of the strap 204. Application of a withdrawal force causes counterclockwise rotation of the pawl 208 which causes firm wedging engagement of the strap between edge portions 272 and 274 and the opposing outer side surfaces 284 and 286 defined in passageways 222 and 224, respectively. Counterclockwise rotation of the pawl 208 causes the edges 272 and 274 to extend or project even farther into the adjacent strap passageways 222 and 224 enhancing wedging engagement. Shoulders 248 and 250 form positive stop abutment surfaces for limiting counterclockwise rotation of the pawl 208.

Figure 18:
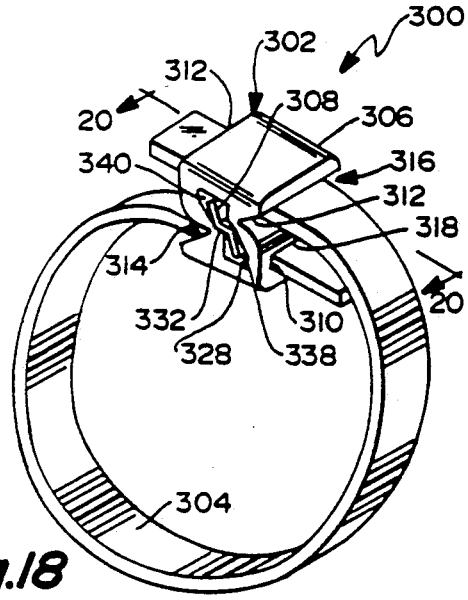
FIG. 18 is a perspective view of another alternate cable tie arrangement in accordance with the present invention.
Figure 19:
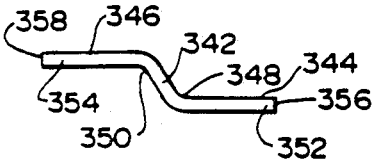
FIG. 19 is a side elevation view of the pawl for use in the alternate cable tie arrangement shown in FIG. 18.
Figure 20:
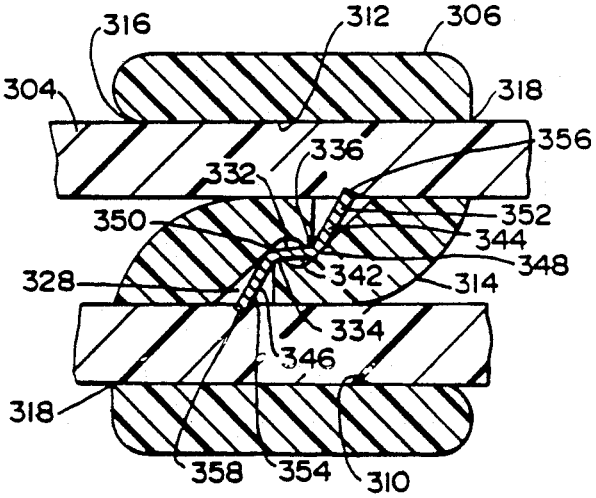
FIG. 20 is an elevated cross-sectional view of the alternate tie head, taken along view lines 20—20 in FIG. 18.

Referring now to FIGS. 18–20, another alternate cable tie arrangement 300 is shown. Tie arrangement 300 is also of an opposite side, parallel-entry type, similar to arrangement 200 shown in FIG. 14. Tie arrangement 300 comprises a tie head 302 and tie strap 304. Tie head 302 includes a housing 306 having a Z-shaped cross-sectional configuration as shown in FIG. 20, and a metallic pawl member 308. Housing 306 is provided with a pair of vertically spaced parallel slots defining strap-receiving passageways 310 and 312 each having an entrance opening 314, 316 and an exit opening 318 and 320 defined in a pair of opposing end walls 322 and 324, as shown. A pawl receiving channel 326 extends intermediate passageways 310 and 312 between a pair of channel openings 328 and 330 defined in opposing sidewalls 332 and 334. Channel openings 328 and 330 are substantially normal to the entrance openings 314 and 316 in housing 306.

Pawl receiving channel 326 includes an intermediate portion 332 including a pair of spaced and juxtaposed rounded corners 334 and 336, as well as, a pair of spaced and opposed lobe portions 338 and 340 as shown. Intermediate portions of lobe portions 338 and 340 intersect the respective adjacent passageways 310 and 312.

Alternate pawl member 308 for use in tie head 302 is shown in FIGS. 19–20. Pawl 308 includes an intermediate base portion 342 and a pair of arms 344 and 346 angularly extending from opposed sides of base 342 to define a pair of opposed inner bend sections 348 and 350. Arms 344 and 346 each extend to a free end 352, 354 having an edge portion 356, 358.

Referring now to FIG. 20, pawl 308 is inserted into channel 326 through one of the channel openings 328, 330, so that base portion 342 is received in intermediate portion 332 of channel 326 and so that inner bend 348 lies adjacent rounded corner 334 and inner bend 350 lies adjacent rounded corner 336, as shown. Pawl 308 may be retained in channel 326 by heat staking portions of the housing 306 adjacent channel openings 328 and 330. In this condition the pawl 308 is also pivotally mounted in channel 326 so that free ends 352 and 354 may be independently or simultaneously rotated or deflected in clockwise and counterclockwise directions. As will be apparent to those skilled in the art, the strap engaging operation of assembled tie head 302 is similar to tie head 202.

Figure 21:
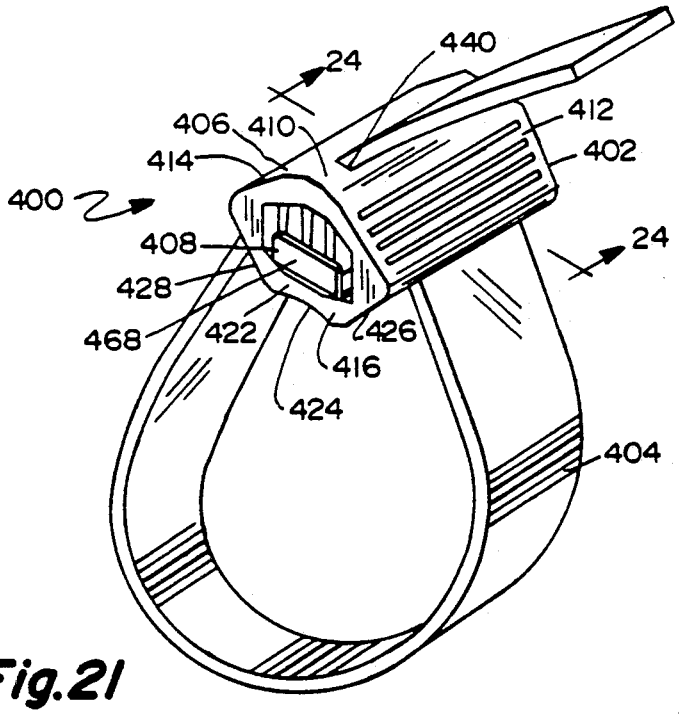
FIG. 21 is a perspective view of still another alternate cable tie arrangement in accordance with this invention.

In FIGS. 21–24, still another alternate cable tie arrangement 400 in accordance with this invention is shown. As shown in FIG. 21, tie arrangement 400 includes a tie head 402 and tie strap 404. Tie head 402 is of a same-side, non-parallel entry type wherein the strap ends are retained at an angled orientation with respect to each other within tie head 400.

More particularly, tie head 402 includes a tie head housing 406 and a pawl member 408. Housing 406 includes a top wall 410, a pair of spaced and opposed angled sidewalls 412 and 414, a bottom wall 416 and a pair of opposed end walls 418 and 420. Bottom wall 416 has a w-shaped configuration including a central portion 422 having an arcuate convex cable engaging recess 424 and a pair of upwardly and outwardly angled lateral portions 426 and 428. A pair of strap receiving passageways 430 and 432 are provided extending substantially parallel to and adjacent side walls 412 and 414. Passageway 430 includes a tapered entrance opening 434 defined in lateral portion 426 of bottom wall 416. A forward strap stop surface 436 forms a closed upper end for passageway 430. Passageway 432 includes a tapered entrance opening 438 provided in lateral portion 428 of bottom wall 416 and an exit opening 440 defined in top wall 410. Passageways 430 and 432 each include an outer surface 442 and 444 which extend substantially parallel to sidewall 412 and 414, respectively.

Figure 23:
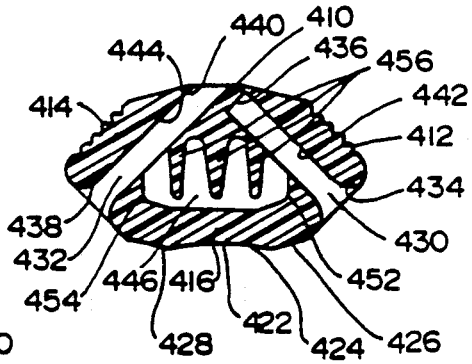
FIG. 23 is an elevated cross-sectional view of the tie head housing for use in the tie arrangement of FIG. 21.

Housing 406 also includes a pawl receiving channel 446 extending intermediate passageways 430 and 432 between a pair of opposed channel openings 448 and 450 disposed in end walls 418 and 420, respectively. An intermediate portion of channel 446 intersects each of passageways 430 and 432 as shown in FIG. 23. A pair of opposed lower shoulder formations 452 and 454 are defined along the lower sides of channel 446. A plurality of parallel spaced retention ribs 456 project downwardly from an upper portion of channel 446.

Figure 22:
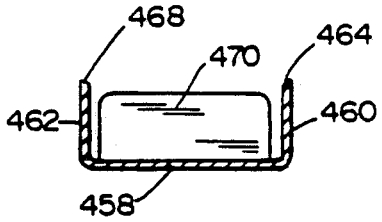
FIG. 22 is an elevated side view of the pawl for use in the tie head shown in FIG. 21.
Figure 24:
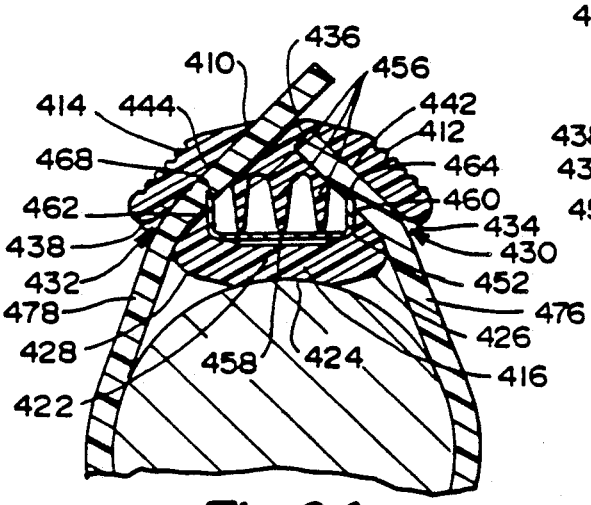
FIG. 24 is an elevated cross-sectional view of the cable tie arrangement taken along view lines 24—24 in FIG. 21.

Tie head 402 additionally includes pawl member 408 as shown in FIGS. 21–22 and 24. Pawl member 408 has an open top box configuration defined by a planar rectangular base portion 458 and a pair of opposed upstanding arms 460 and 462 extending generally perpendicularly from opposed sides of base portion 458 to a chamfered free end blade contact section 464 and 466. Pawl 408 is additionally provided with a pair of rectangular end panels 468 and 470 extending from opposing ends of base portion 458, which originally extend outwardly from and coplanar with the base 458 prior to insertion of pawl 408 within housing 406. Pawl 408 may be stamped and formed from sheet metal stock in accordance with well known methods.

Tie head 402 is assembled by inserting the base portion 458 of pawl 408 between retention ribs 456 and the opposed shoulder formations 452 and 454 in channel 446 so that coplanar end panels 468 and 470 extend outwardly from the opposed channel openings 448 and 450. Thereafter, end panels 468 and 470 are formed upwardly from the base 458, by assembly tooling or otherwise, so that they extend perpendicular to the base portion 458 and lie parallel to end walls 418 and 420, thereby mounting the pawl 408 in channel 446.

In the mounted or assembled condition, shown in FIG. 24, the right angle bends 472 and 474 connecting arms 460 and 462 to base portion 458 are received in shoulder formations 452 and 454 and are biased thereagainst by the opposing action of retention ribs 456. Free end blade contact sections 464 and 466 extend into adjacent passageways 430 and 432 for lockingly engaging the inserted strap 404.

More particularly, a first end 476 of strap 404 is inserted through entrance opening 434 into passageway 430 until its leading edge engages forward strap stop 436. During this insertion, bladed free end 464 is resiliently deflected inwardly to permit passage of the strap end 476. When insertion of end 476 is completed, blade contact section 464 is positioned to bitingly and wedgingly engage strap end 476 against outer surface 442 of passageway 430 to prevent withdrawal of the strap end 476 through entrance opening 434.

With one end 476 of strap 404 positively engaged within passageway 430, the opposed strap end 478 may be passed around the cable or bundle to be tied and inserted through entrance 438 of passageway 432 until end 478 extends outwardly from exit opening 440. Thereafter strap 404 can be cinched or tightened to place the strap and the articles placed within the looping strap under tension. As strap end 478 moves upwardly through passageway 432 during insertion and tightening, blade contact section 466 and arm 462 are inwardly deflected. When upward movement of the strap ceases, blade contact section 466 resiliently engages the strap causing it to be bitingly and wedgingly engaged between the contact section 446 and outer surface 444 of passageway.

In each of the above described embodiments, both the pawl members and the tie head housings are designed to be symmetrical. Each of the housings is provided with a pair of channel openings which permit the pawls to be inserted from the side into the housing. Because the parts are symmetrical, either end of the pawl can be inserted into either channel opening of the housing. Accordingly, no pre-assembly 180° orientations of the pawls and housings is required in assembly. Moreover, in each of these embodiments, the areas of locking engagement by the pawls against the tie straps are unexposed being located in the interior of the tie heads.

Although the present invention has been described with reference to certain preferred embodiments, modifications or changes may be made therein by those skilled in this art. For example, although the preferred tie head and tie arrangement has been described for use in outdoor environmental applications, the new and improved tie heads and tie arrangements of this invention may be used in interior environments and end uses as well, with a corresponding adjustment in the materials from which they are made, as desired.

Moreover, although in the preferred embodiment, retention of the pawl member was achieved by means of cooperation of the retention rib groove and the curved locking barb surfaces, other mounting arrangements may be apparent to those skilled in the art which will achieve the function of permanently retaining the pawl member within the channel of the housing which may or may not have a self-centering characteristic.

All such obvious modifications and changes may be made herein by those skilled in this art without departing from the scope and spirit of this invention, as defined in the appended claims.

We claim:

1. A tie head for use with an elongate plastic tie strap to form a bundle tie, said tie head comprising:

a tie head housing including a pair of spaced-apart slots extending therein forming a pair of strap-receiving passageways, each passageway having an entrance opening, at least one of said passageways having an exit opening, said housing further including a pawl-receiving channel extending intermediate the passageways, said channel having at least one channel opening disposed substantially normal to said entrance openings, said channel having an intermediate portion intersecting each said passageway;

a pawl member mounted in said channel including an elongate base portion and a pair of arm portions extending outwardly from opposed sides of the base, each arm having a free end with a blade section, each of said free ends extending from the channel into one of said passageways; and mounting means for retaining the pawl in position in the housing, whereby a tie strap inserted through the entrance openings into each passageway is retained by the tie head against withdrawal by gripping engagement of the strap between the blade sections and surfaces of said passageways.

2. A tie head as in claim 1, wherein the passageways are disposed at an angled orientation with respect to each other.

3. A tie head as in claim 1, wherein the passageways are parallel to each other.

4. A tie head as in claim 1, wherein said housing is a one piece housing.

5. A tie head as in claim 1, wherein said pawl is a one piece pawl.

6. A tie head as in claim 1, wherein said housing is a unitary thermoplastic molded housing.

7. A tie head as in claim 1, wherein said pawl is a unitary metallic stamping.

8. A tie head as in claim 1, wherein said gripping engagement of an inserted strap occurs along unexposed portions of the strap within the tie head housing.

9. A tie head as in claim 1, wherein said mounting means includes at least one retention rib extending within the channel intermediate the length thereof adapted for press-fit engagement with the base of the pawl upon insertion of the pawl into the channel through one of said channel openings.

10. A tie head as in claim 1, wherein said mounting means includes at least one retention rib extending within the channel intermediate the length thereof and at least one mounting projection on said pawl member adapted for press-fit engagement with said retention rib upon insertion of the pawl into the channel through one of said channel openings.

11. A tie head as in claim 10, wherein said mounting projection is stuck out from the base portion of the pawl.

12. A tie head as in claim 1, wherein said mounting means includes self-centering means for guiding and retaining the pawl member in aligned position within the channel.

13. A tie head as in claim 1, wherein said self-centering mounting means includes a retention rib extending within the channel intermediate the length thereof and defining a constricted region within the channel, the retention rib having a free end with an elongate groove therein along the constricted region and pair of mounting barb projections extending normally from the base portion of the pawl, each projection having an opposed free end having an edge portion configured to be cooperatively received in said groove, said groove receiving and engaging the configured edges of each projection on the inserted pawl in a surface to surface press-fit contact, thereby centering the pawl within the channel and preventing displacement of the pawl in substantially any lateral or rotational direction with respect to the housing.

14. A tie head as in claim 13, wherein said groove is a convex semi-circular groove and the edges of said projections are rounded, semi-circular edges.

15. A tie head for use with an elongate plastic tie strap to form a bundle tie, said tie head comprising:

a generally rectangular tie head housing including a pair of spaced and opposed sidewalls interconnected by a pair of opposed end walls, a bottom wall and an opposed top wall, said housing further including a pair of generally parallel spaced apart slots extending therethrough forming a pair of strap-receiving passageways, each passageway having a surface extending adjacent a sidewall and having a bottom wall entrance opening and a top wall exit opening, said housing further including a pawl-receiving channel extending through the housing intermediate the passageways having an opening in each of said endwalls, an intermediate portion of said channel intersecting each said passageway;

a pawl member mounted in said channel including an elongate base portion and a pair of cantilevered arms extending outwardly and upwardly from opposed sides of the base intermediate the length thereof, each arm having a free end with a blade section extending therefrom, each of said free ends extending from the channel into the adjacent passageway; and mounting means for retaining the pawl in position in the channel, whereby, a tie strap inserted through the entrance openings into each passageway is retained by the tie head against withdrawal by gripping engagement of the strap between the blade sections and the surfaces of the passageways.

16. A tie head as in claim 15, wherein said housing comprises a one-piece thermoplastic molded housing.

17. A tie head as in claim 15, wherein said housing comprises a thermoplastic polyacetal molded housing.

18. A tie head as in claim 15, wherein each blade section comprises a pair of spaced blade contacts for developing four independent lines of gripping engagement with an inserted tie strap between each blade contact and portions of the surfaces of the passageways adjacent the end walls of the housing.

19. A tie head as in claim 15, wherein each of the free ends of the pawl arms further include a stop surface effective to limit penetration of the blade sections into the strap to a given depth.

20. A bundle tie arrangement for loopingly securing an article or a plurality of articles under tension, said arrangement comprising:

a plastic tie strap having a pair of ends and having a length sufficient to surroundingly engage an article or plurality of articles to be secured by the bundle tie; and a tie head including a tie head housing having a pair of spaced apart slots extending therein forming a pair of strap-receiving passageways adapted to closely slidably receive the ends of said tie strap, each passageway having an entrance opening, at least one of said passageways having an exit opening, said housing further including a pawl receiving channel extending intermediate the passageways, said channel having at least one channel opening disposed substantially normal to said entrance openings, said channel having an intermediate portion intersecting each said passageway; and a pawl member mounted in said channel having an elongate base portion and a pair of arms extending outwardly from opposed sides of the base, each arm having a free end with a blade section and each of said free ends extending from the channel into one of said passageways, each strap end extending through an entrance opening into a passageway and retained by the tie head against withdrawal by gripping engagement of the strap between the blade sections and surfaces of said passageways, and remaining portions of said strap loopingly surrounding the article to be tied whereby, the bundle tie may be placed under tension by pulling a strap end through the exit opening until the tie strap is tightened to securely engage the article.

21. A tie head housing for use with an elongate plastic tie strap and at least one pawl member to form a bundle tie, said tie head housing comprising: a housing body including a pair of spaced-apart slots extending therein forming a pair of strap-receiving passageways, each passageway having an entrance opening, at least one of said passageways having an exit opening, said housing body further including at least one pawl-receiving channel extending adjacent the passageways, each said channel having at least one channel opening disposed substantially normal to said entrance openings and each said passageway having an intermediate portion intersecting a said channel.

* * * * *